US008573004B2

(12) United States Patent
Demeglio

(10) Patent No.: US 8,573,004 B2
(45) Date of Patent: Nov. 5, 2013

(54) FINGER RING PROVIDED WITH AN ADAPTER DEVICE FOR AUTOMATICALLY ADJUSTING THE RING SIZE

(75) Inventor: Roberto Demeglio, Moriondo Torinese (IT)

(73) Assignee: 1922 Manifatture Preziose Torino S.P.A, Torino (IT)

( * ) Notice: Subject to any disclaimer, the term of this patent is extended or adjusted under 35 U.S.C. 154(b) by 92 days.

(21) Appl. No.: 12/865,037

(22) PCT Filed: Jan. 27, 2009

(86) PCT No.: PCT/IB2009/000129

§ 371 (c)(1),
(2), (4) Date: Nov. 19, 2010

(87) PCT Pub. No.: WO2009/095761

PCT Pub. Date: Aug. 6, 2009

(65) Prior Publication Data

US 2011/0048073 A1 Mar. 3, 2011

(30) Foreign Application Priority Data

Jan. 28, 2008 (IT) ..... TO2008A0056

(51) Int. Cl.
*A44C 9/02* (2006.01)

(52) U.S. Cl.
USPC ..... 63/15.6; 63/15.65

(58) Field of Classification Search
USPC ..... 63/15.5, 15.6, 15.65, 5.1, 41; 267/158, 267/160, 164; 24/279; 285/23
See application file for complete search history.

(56) References Cited

U.S. PATENT DOCUMENTS

| | | | | | |
|---|---|---|---|---|---|
| 389,292 | A | * | 9/1888 | Flohr | 5/237 |
| 486,720 | A | * | 11/1892 | Lehman | 63/15.6 |
| 2,582,083 | A | * | 1/1952 | Tarter et al. | 63/15.7 |
| 2,615,314 | A | * | 10/1952 | Axel | 63/15.6 |
| 2,745,265 | A | * | 5/1956 | Grafstein | 63/15.6 |
| 2,745,266 | A | * | 5/1956 | Grafstein | 63/15.6 |
| 2,778,207 | A | * | 1/1957 | Thaler | 63/15.6 |
| 2,787,142 | A | * | 4/1957 | Axel | 63/15.6 |

(Continued)

FOREIGN PATENT DOCUMENTS

CH 695 205 A5 1/2006

OTHER PUBLICATIONS

European Patent Office, International Search Report and Written Opinion, dated May 10, 2009.

*Primary Examiner* — Jack W. Lavinder
*Assistant Examiner* — Abigail E Morrell
(74) *Attorney, Agent, or Firm* — Moore & Van Allen PLLC

(57) ABSTRACT

A ring (1) defines a seat (3) for being worn on a finger and has an adapter device (10) capable of automatically adjusting the diameter of the seat (3); the adapter device (10) is provided with at least one arm (11) coupled to a structure (2) of the ring (1) so as to move between a retracted position and a forward position with respect to the center of the seat (3); the arm (11) is pushed to the forward position by at least one elongated spring (22), which substantially extends in a circumferential direction and has a first end portion (23) fixed to either the structure (2) or the arm (11), and a second end portion (28), opposite to the first (23) and arranged resting against the other (2) of either the structure or the arm.

11 Claims, 3 Drawing Sheets

(56) References Cited

U.S. PATENT DOCUMENTS

| | | | | | |
|---|---|---|---|---|---|
| 2,873,586 | A | * | 2/1959 | Krandall | 63/15.6 |
| 3,237,426 | A | * | 3/1966 | Doering | 63/15.6 |
| 3,423,956 | A | * | 1/1969 | Manne | 63/15.45 |
| 3,483,718 | A | * | 12/1969 | Lodrini | 63/15.6 |
| 4,245,485 | A | * | 1/1981 | Bushong | 63/15.6 |
| 4,471,634 | A | * | 9/1984 | Kaplan | 63/15.6 |
| 4,935,977 | A | * | 6/1990 | Yamada | 5/237 |
| 4,991,409 | A | | 2/1991 | Creates | |
| 5,269,497 | A | * | 12/1993 | Barth | 267/110 |
| 5,499,430 | A | * | 3/1996 | Strazar | 24/279 |
| 6,003,334 | A | * | 12/1999 | Miller | 63/15.5 |
| 6,088,886 | A | * | 7/2000 | Gyongyosi | 24/279 |
| 6,748,764 | B1 | | 6/2004 | Roemer | |
| 7,409,836 | B2 | * | 8/2008 | Czajka et al. | 63/15.6 |
| 7,430,879 | B2 | * | 10/2008 | Czajka et al. | 63/15.6 |
| 2002/0178749 | A1 | | 12/2002 | Katano | |
| 2006/0162380 | A1 | * | 7/2006 | Czajka et al. | 63/15.6 |
| 2007/0137249 | A1 | * | 6/2007 | Czajka et al. | 63/15.6 |
| 2008/0163646 | A1 | * | 7/2008 | Czajka et al. | 63/15.6 |

* cited by examiner

FINGER RING PROVIDED WITH AN ADAPTER DEVICE FOR AUTOMATICALLY ADJUSTING THE RING SIZE

CROSS-REFERENCE TO RELATED APPLICATIONS

This application claims the benefit under 35 U.S.C. 365(c) of International Application No. PCT/IB2009/000129, filed Jan. 27, 2009, which claims priority to Italian Application No. TO2008A 000056, filed Jan. 28, 2008, both of which are incorporated by reference in their entirety.

TECHNICAL FIELD

The present invention relates to a finger ring provided with an adapter device for automatically adjusting the ring size.

BACKGROUND ART

Automatic adjustment devices which allow to have a single ring which may be worn on fingers different in circumference are known.

For example, U.S. Pat. No. 6,748,764 describes a ring comprising a circular structure which defines an internal cavity which accommodates one or more springs. Such springs act against one or more arms hinged to the structure, so as to rotate the arms towards the interior of the ring against the finger on which the ring is worn. In such a manner, the position of the arms with respect to the centre of the ring may be automatically adapted according to the size of the finger on which the ring is worn.

The known solutions shown in U.S. Pat. No. 6,748,764 are poorly satisfactory, because the type of springs and the mode for assembling the springs into the structure of the ring require internal cavities having relatively large dimensions in the radial direction.

Furthermore, at least in some known solutions disclosed in U.S. Pat. No. 6,748,764, the springs have no fixed position in the internal cavity of the whereby they could move in use, with the consequent risk of preventing or limiting the automatic adaptation of the arm position.

DISCLOSURE OF INVENTION

It is an object of the prevent invention to provide a finger ring provided with an adapter device for automatically adjusting the size of the ring, which allows to solve the aforesaid problems in a simple and cost-effective manner.

According to the present invention, there is provided a ring defining a seat to be worn on a finger and comprising:

a structure; and an adapter device for automatically adjusting the diameter of the seat, the adapter device comprising:

a) at least one arm coupled to said structure so as to rotate between a retracted position and a forward position with respect to the centre of said seat, and b) elastic means radially interposed between said structure and said arm to push said arm to the forward position;

characterized in that said elastic means comprise at least one elongated elastic element, which substantially extends in the circumferential direction and comprises:

a first end portion fixed to one between said structure and said arm, and a second end portion, opposite to the first and arranged resting against the other between said structure and said arm.

BRIEF DESCRIPTION OF THE DRAWINGS

The invention will now be described with reference to the accompanying drawings which illustrate a non-limitative embodiment thereof, in which.

BEST MODE FOR CARRYING OUT THE INVENTION

Figure 1:
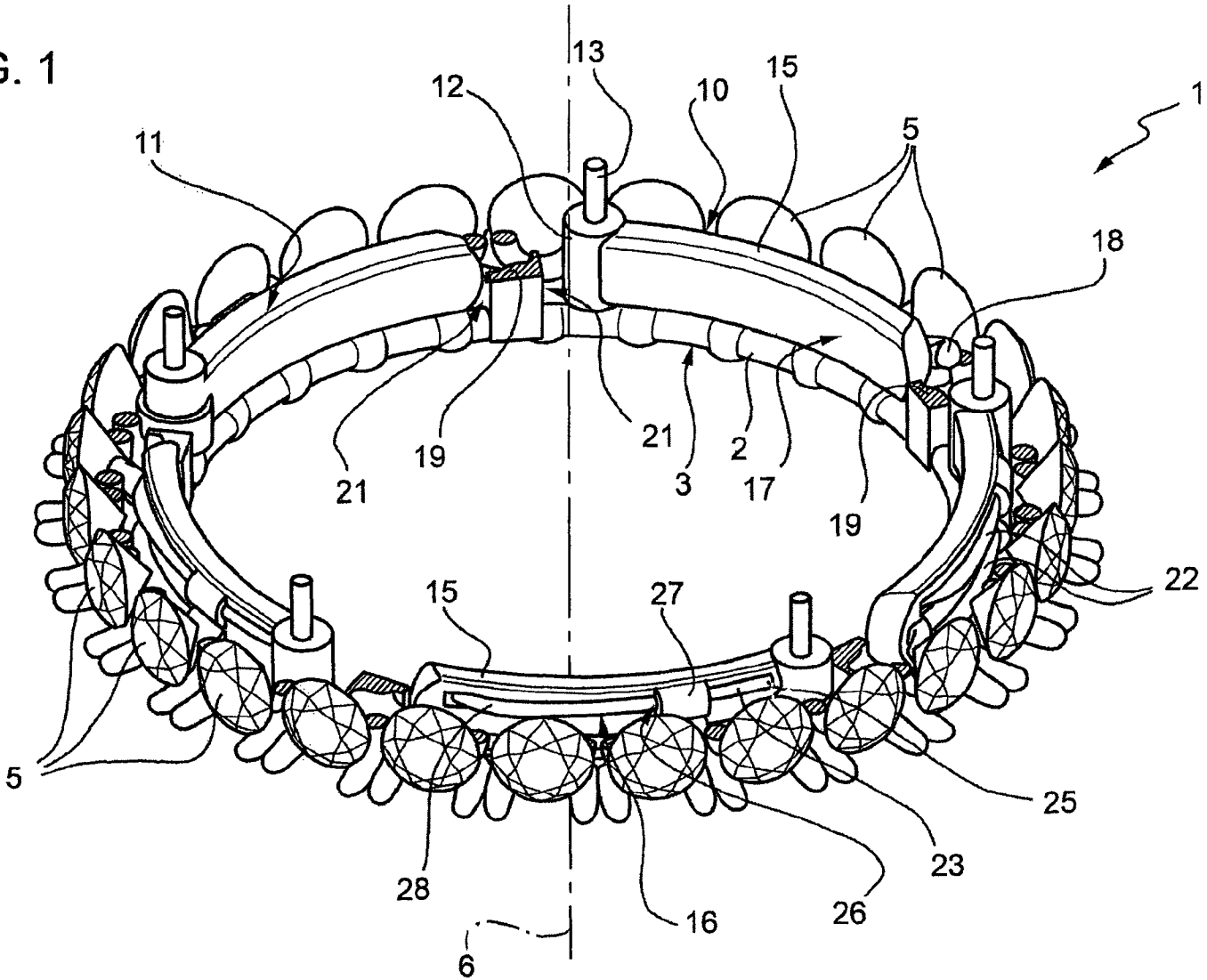
FIG. 1 is a perspective view which shows, with parts removed for clarity, a first preferred embodiment of the finger ring provided with an adapter device for automatically adjusting the ring size according to the present invention.

In FIG. 1, numeral 1 indicates as a whole a ring defining a substantially circular seat 3, in which a finger may be inserted along an axis 6 for wearing the ring 1 on such a finger.

The ring 1 comprises: an annular structure 2, which is shown in section according to a symmetry plane orthogonal to axis 6; a series of precious stones 5, which are set on the structure 2, in fixed positions along the external periphery of the structure 2 and are angularly spaced about the axis 6; and an adapter device 10 for automatically adjusting the diameter of the seat 3, i.e. the size of the ring 1, according to the circumference of the finger on which the ring 1 is worn.

The device 10 comprises five arms 11 arranged along the internal periphery of the structure 2 in order to delimit the seat 3. The arms 11 are equally spaced about the axis 6 and coupled to the structure 2 so as to rotate between a retracted position and an forward position with respect to the centre of the seat 3.

Specifically, the ends of the arms 11 are defined by bushings 12 coupled to respective hinge pins 13, which are parallel to axis 6 and define the rotation axes of the arms 11. The axial ends of the pins 13 protrude from the bushings 12 and engage respective circular through holes (not shown) of the structure 2.

The arms 11 comprise respective intermediate portions 15, which extend in a substantially circumferential direction and have a U-shaped cross section, considering section planes passing through axis 6, so as to define respective compartments 16, on the rear side radially facing the structure 2. On the opposite side, i.e. towards the centre of the seat 3, the portions 15 have respective arched surfaces 17 which, in use, are in contact with the finger on which the ring 1 is fitted.

At the opposite end in the circumferential direction with respect to the bushings 12, each arm 11 comprises a corresponding tooth 18, which protrudes from the portion 15, both circumferentially in the opposite direction with respect to the bushing 12, and radially outwards.

When the arms 11 are arranged in their forward position, the teeth 18 are arranged resting against respective shoulders 19 of the structure 2 to define the stroke stop for adjusting the arms 11. The shoulders 19 are interposed between the arms 11 in the circumferential direction and define five windows 21 which are engaged by the arms 11, respectively.

For each arm 11, the device 10 comprises a corresponding pair of wire springs 22. The wire springs 22 of each pair are radially interposed between the structure 2 and the arm 11 to push the arm 11 to the forward position, are elongated in the circumferential direction, and are parallel and spaced from one another.

For each arm 11, the two wire springs 22 comprise respective substantially rectilinear portions 23, which are tangential to the arm 11, accommodated in the compartment 16, and fixed to the arm 11. Specifically, the ends of the portions 23 are fixed to the bushing 12 by means of welding zones 25 obtained by means of laser.

The portions 23 engage respective passages 26 defined by the bottom surface of the compartment 16 and corresponding semi-cylindrical portions 27, which are fixed to the bottom surface of the compartment 16. The portions 23 have a diameter which approximates by defect the size of the passages 26, and therefore may be easily inserted into the portions 27 during the step of assembling.

At the opposite end with respect to the portions 23, the two wire springs 22 comprise respective arched portions 28, which extends outside the compartment 16, have a concavity facing towards the arm 11, and rest against the structure 2. The end tips of the portions 28 are radially spaced from arm 11 and structure 2 when the arm 11 is in the forward position towards the centre of the seat 3.

Figure 2:
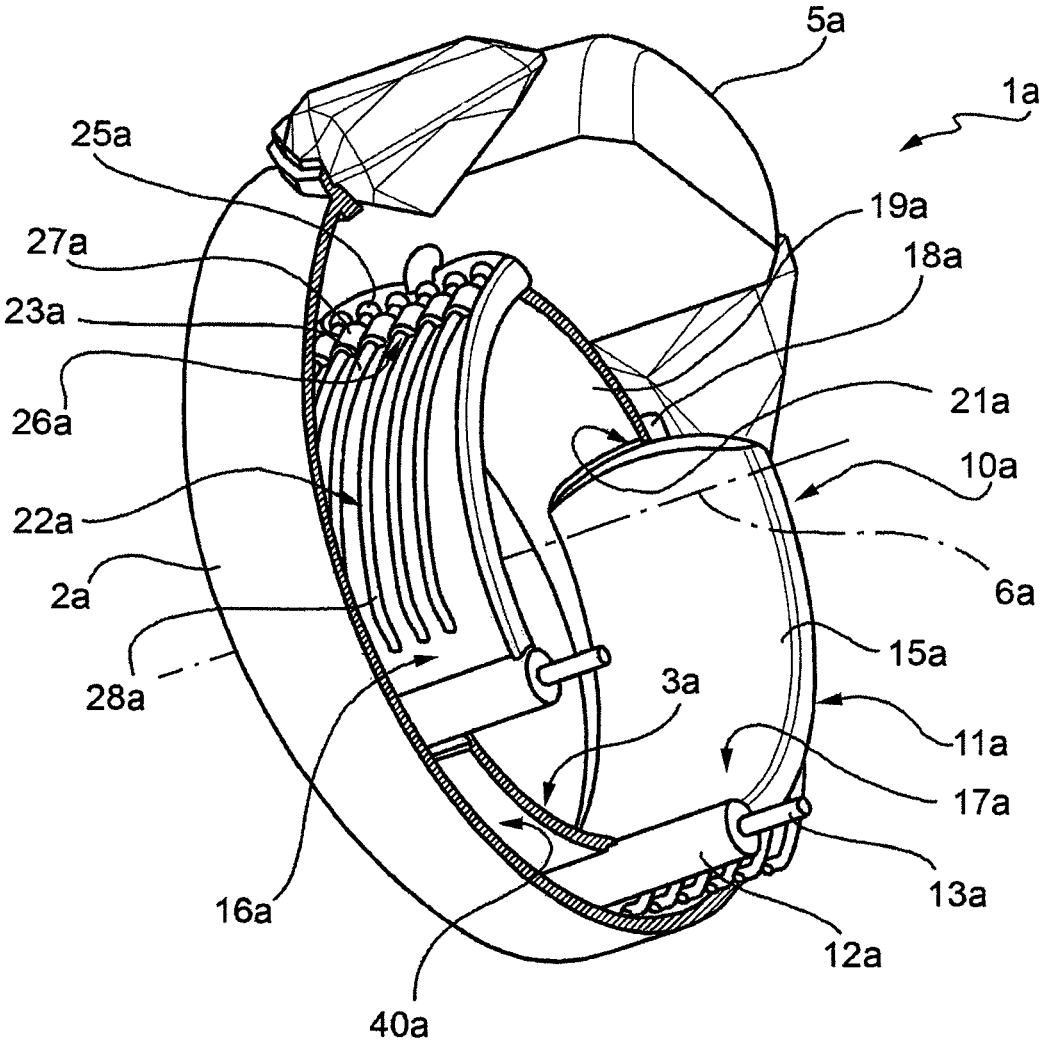
FIGS. 2 and 3 are similar to FIG. 1 and show second and third preferred embodiments of the finger ring according to the present invention, respectively.

FIG. 2 shows a ring 1*a*, in which the components are indicated by the same reference numbers used in FIG. 1 and are followed by the reference letter "a". Unlike the ring 1, the precious stones 5*a* are arranged only on one side of the structure 2*a*, and not along the entire periphery. The structure 2*a* defines an internal channel 40*a*, which accommodates the springs 22*a* and communicates with the seat 3*a* through the windows 21*a*. Specifically, the windows 21*a* as well as the arms 11*a* are two, and diametrically opposite to each other. The hinge pins 13*a* are arranged in a zone which is diametrically opposite to the precious stone 5*a*, whereby the arms 11*a* secure the finger without pushing it towards the precious stone 5*a* when the ring 1 is worn.

Specifically, there are six wire springs 22*a* for each arm 11*a*. The ends of the portions 23*a* are arranged in the compartment 16*a* and are fixed through the welding zones 25*a* to the end of the portion 15*a* which is opposite, in the circumferential direction, to the bushing 12*a*, whereby the portions 28*a* are facing towards the bushings 12*a*.

Figure 3:
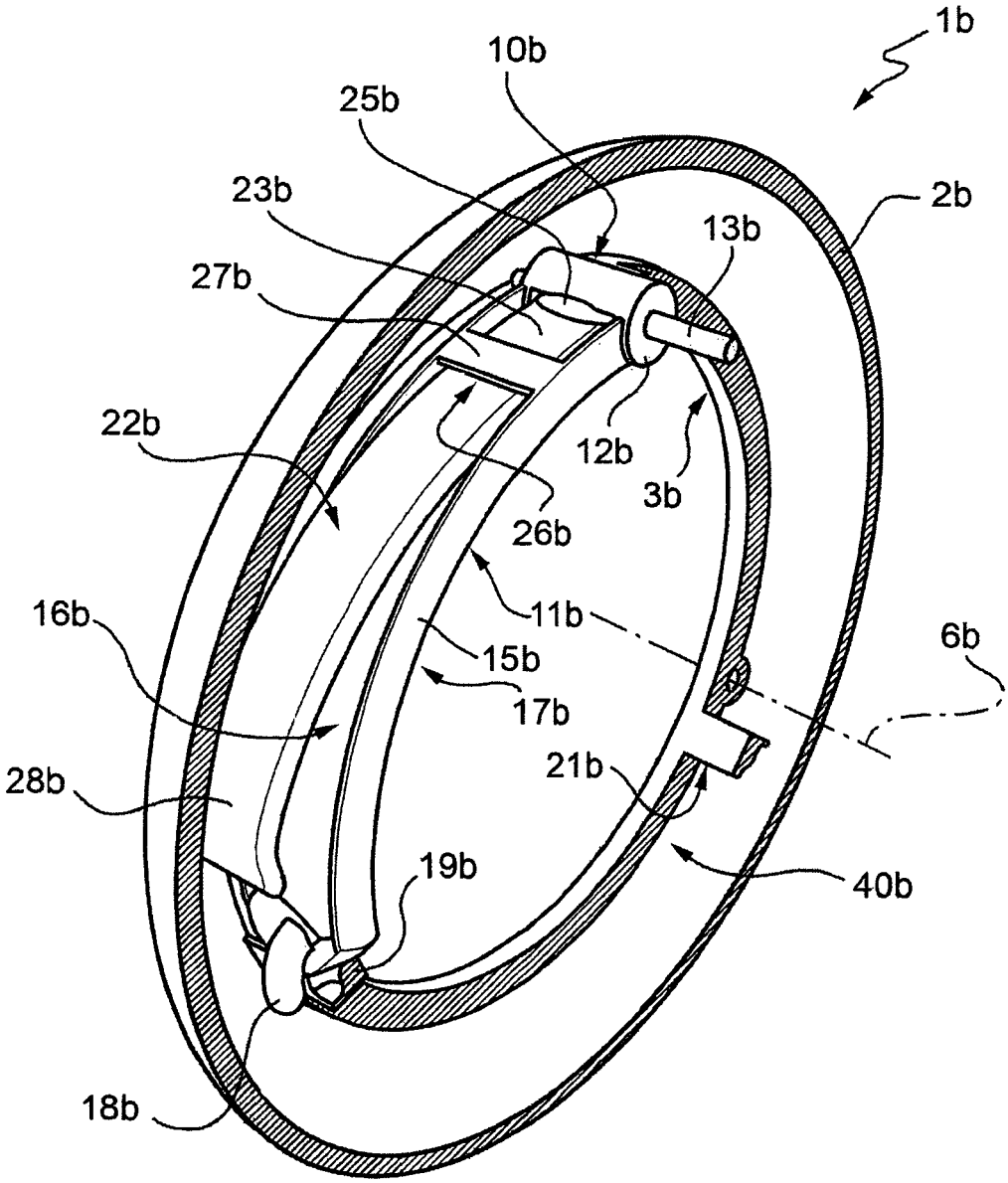

FIG. 3 shows a ring 1*b*, in which the components are indicated by the same reference numbers used in FIGS. 1 and 2 and followed by the reference letter "b". Unlike the ring 1*a*, the structure 2*b* is free from precious stones, defines an internal circular channel 40*b* and has an external shape similar to that of a wedding ring. The windows 21*b* as well as the arms 11*b* (only one of which is shown) are three and arranged at 120°. For each arm 11*b*, the wire springs are replaced with a flat spring 22*b* with a profile having a similar shape to that of the wire springs described above, when seen in the axial direction. The semi-cylindrical portions 27,27*a* are replaced with plate portions 27*b* parallel to the bottom surface of the compartments 16*b* so as to define rectangular section passages 26*b*.

From the above it is apparent that the type of springs used, i.e. springs having a shape elongated in the circumferential direction, allows to achieve a compact structure in the radial direction. Furthermore, fixing one end of the springs 22 to either the arm 11 or the structure 2 allows the springs 22,22*a*, 22*b* to be arranged in constantly fixed positions, both when assembling the arms 11,11*a*,11*b* to the structure 2,2*a*,2*b*, resulting in increased simplicity and speed for manufacturing the ring 1, and in use, resulting in an increased reliability of the device 10,10*a*,10*b*.

The device 10,10*a*,10*b* is also reliable in virtue of the portions 27,27*a*,27*b* transmitting the elastic bias between the springs 22,22*a*,22*b* and the arm 11,11*a*,11*b* and avoid such an elastic bias from being directly released onto the welding zones 25,25*a*,25*b*. At the same time, the portions 28,28*a*,28*b* have a concave shape which allows the springs 22,22*a*,22*b* to smoothly slide on the structure 2,2*a*,2*b* during the movement of the arms 11,11*a*,11*b* between the forward and retracted positions.

From the above, it is finally apparent that changes and variations may be made to the described rings 1,1*a*,1*b* without departing from the scope of protection of the present invention, as defined in the appended claims.

Specifically, the mode for fastening the springs 22,22*a*,22*b* could be different from welding (e.g. portions 23,23*a*,23*b* could be secured into the passages 26,26*a*,26*b* by crushing the portions 27,27*a*,27*b*); and/or the number of arms 11,11*a*, 11*b*, could be different from that indicated by way of example. Furthermore, the number of wire springs 22,22*a* or flat springs 22*b* could be different from that shown in the appended figures; and/or one end could be fixed to the structure instead of to the arms, in a dual manner with respect to that shown above by way of example.

The invention claimed is:

1. A ring defining a seat for being worn on a finger and comprising:

a structure; and an adapter device for automatically adjusting the diameter of the seat, the adapter device comprising:

a) at least three arms, equally spaced along an internal periphery of the structure, each one of the arms coupled to said structure so as to rotate between a retracted position and a forward position with respect to the center of said seat; and b) elastic means radially interposed between said structure and each arm to push each arm to the forward position; said elastic means comprising a plurality of parallel and spaced elongated elastic elements, wherein each elongated elastic element has a profile substantially extending in a circumferential direction and comprises a wire spring, each wire spring comprising:

a first end portion having an end fixed to one of said structure and a respective one of said at least three arms at a welding zone; and a second end portion, opposite to said first end portion along said circumferential direction and arranged resting against the other of said structure and said respective one of said at least three arms.

2. The ring according to claim 1, wherein said end of each first end portion is fixed by means of laser welding.

3. The ring according to claim 1, wherein said end of each first end portion is fixed to said respective one of said at least three arms.

4. The ring according to claim 3, wherein said first end portion is defined by a substantially rectilinear portion, tangential to said respective one of said at least three arms and engaging a passage which is fixed with respect to said respective one of said at least three arms.

5. The ring according to claim 4, wherein the size of said substantially rectilinear portion is approximately the size of said passage, to insert said end into said passage during the assembly.

6. The ring according to claim 5, wherein said passage is defined by a rear surface of said respective one of said at least three arms and a semi-cylindrical portion fixed to said rear surface.

7. The ring according to claim 3, wherein said respective one of said at least three arms has a U-shaped cross section and defines a rear compartment accommodating said end.

8. The ring according to claim 3, wherein said end of each first end portion is fixed at said welding zone to a hinging bushing of said respective one of said at least three arms.

9. The ring according to claim 3, wherein said second end portion is arched with a concavity facing towards said respective one of said at least three arms.

10. The ring according to claim 1, wherein said structure defines an internal channel, which accommodates said elastic means and communicates with said seat through a window engaged by said respective one of said at least three arms.

11. The ring according to claim 1, wherein each arm includes a pivotally mounted end and a free end, and further comprising a protrusion extending from proximate to the free end of each arm and a shoulder extending from the structure, wherein the protrusion is positioned radially outward from the shoulder, and wherein when each arm rotates from the retracted position to the forward position, the forward position of each arm is determined by the position at which each respective protrusion is blocked by each respective shoulder.

* * * * *